US006338213B1

(12) United States Patent
Young et al.

(10) Patent No.: US 6,338,213 B1
(45) Date of Patent: Jan. 15, 2002

(54) NON TIPPABLE POP-UP CAUTION SIGN

(75) Inventors: Ronald Scot Young, Dudley Wood; Ronald Stuart Glendenning, North Droitwich, both of (GB)

(73) Assignee: Scot Young Research, Ltd., Stourbridge (GB)

( * ) Notice: Subject to any disclaimer, the term of this patent is extended or adjusted under 35 U.S.C. 154(b) by 0 days.

(21) Appl. No.: 09/566,852

(22) Filed: May 8, 2000

(30) Foreign Application Priority Data

Sep. 21, 1999 (GB) ..... 99221897

(51) Int. Cl.[7] ..... G09F 15/00

(52) U.S. Cl. ..... 40/610; 40/606

(58) Field of Search ..... 40/606, 610, 612; 404/6

(56) References Cited

U.S. PATENT DOCUMENTS

| | | | | | |
|---|---|---|---|---|---|
| 4,298,186 | A | * | 11/1981 | Glass | 40/606 |
| 4,516,344 | A | * | 5/1985 | Seely | 40/606 |
| 4,796,369 | A | * | 1/1989 | Hamann | 40/606 |
| 5,046,885 | A | * | 9/1991 | Thurston | 404/10 |
| 5,964,053 | A | * | 10/1999 | Liu | 40/610 |
| 6,131,320 | A | * | 10/2000 | Eberle et al. | 40/610 |

* cited by examiner

*Primary Examiner*—Christopher P. Schwartz
(74) *Attorney, Agent, or Firm*—Wm. Bruce Day

(57) ABSTRACT

A warning sign for cautioning pedestrians away from spillages or wet floor areas is formed of a pair of swing legs connected at upper ends so that they can be spread apart form self-support. An extension member can be pulled upwardly from between the legs to enhance the visual warning effect. A catch in the hinge area selectively locks the extension member to an extended position when the legs are spread apart and allows the extension member to be lowered when the legs are swung together.

4 Claims, 3 Drawing Sheets

1 / 3

NON TIPPABLE POP-UP CAUTION SIGN

This invention relates to a warning sign particularly but not exclusively for use on wet floors in public places.

According to a first aspect of the present invention there is provided a warning sign comprising two parts pivotably connected together at their in use upper ends and having ground contacting foot portions at their in use lower ends, the two parts being pivotable between a first storage position in which the two parts are arranged in side-by-side relationship and a second operative position in which the two parts are at an angle to one another so that with the foot portion or portions of one part spaced from the foot portion or portions of the other part, the sign will be self-supporting on the ground, and detent means for releasably retaining the two parts in the second operative position.

Preferred and/or optional features of the first aspect of the invention are set forth in claims 2 to 7 inclusive.

According to a second aspect of the invention there is provided a warning sign comprising two parts pivotably connected together at their in use upper ends and having ground contacting foot portions at their in use lower ends, the two parts being pivotable between a first storage position in which the two parts are arranged in side-by-side relationship and a second operative position in which the two parts are at an angle to one another with the foot portion or portions of one part spaced from the foot portion or portions of the other part so that the sign will be self-supporting on the ground, a third part which can be raised or lowered relative to the first and second parts and means for releasably supporting the third part in a raised position relative to the first and second parts when the first and second parts are in said second position.

Preferred and/or optional features of the second aspect of the invention are set forth in claims 9 to 11.

Figure 1:
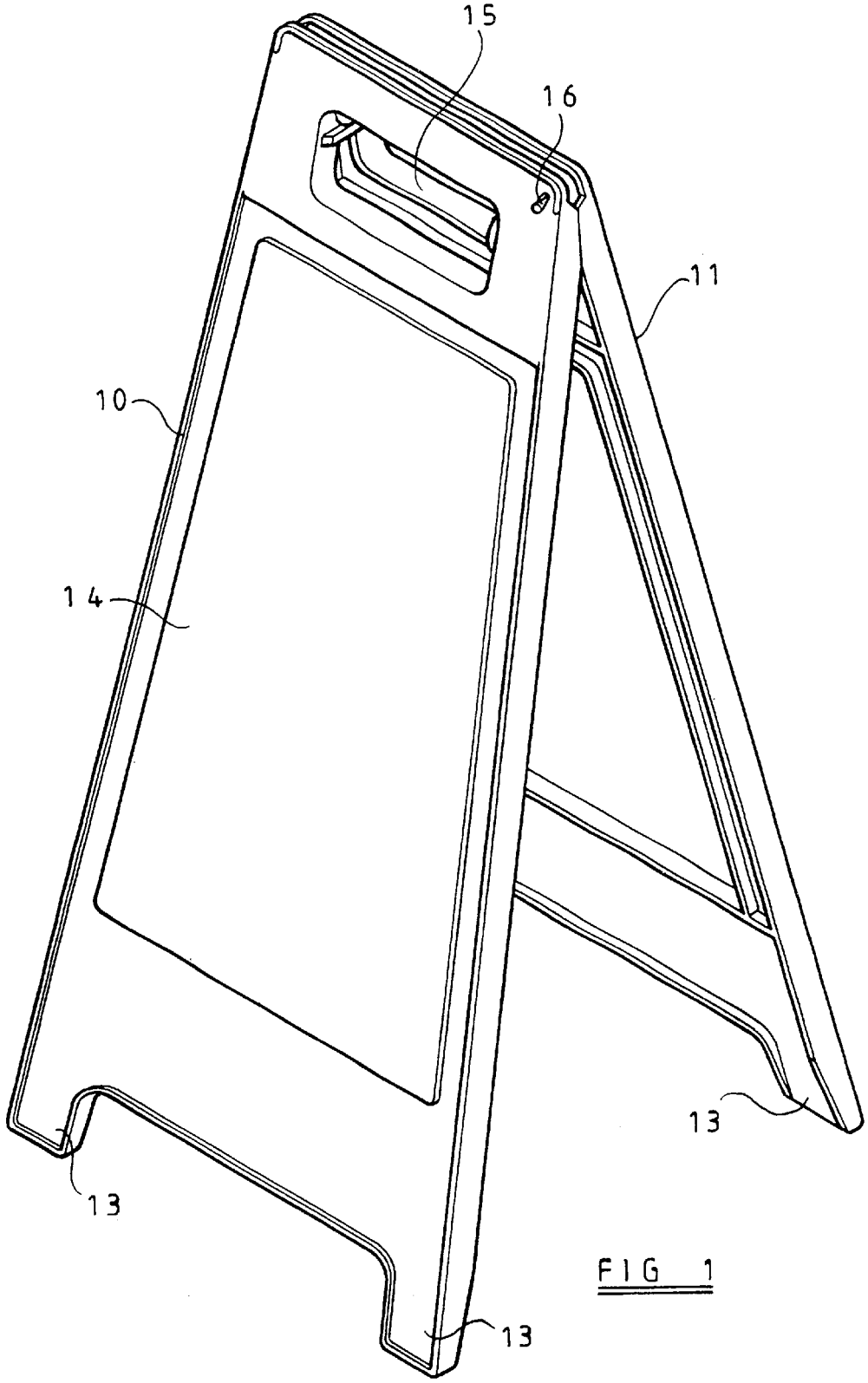
Figure 2:
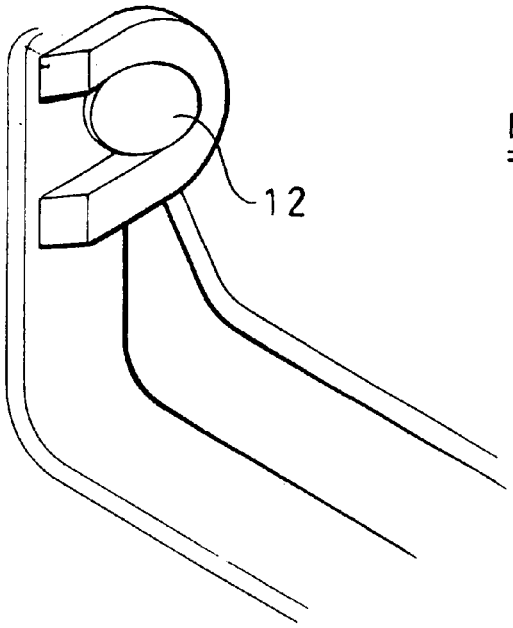
Figure 3:
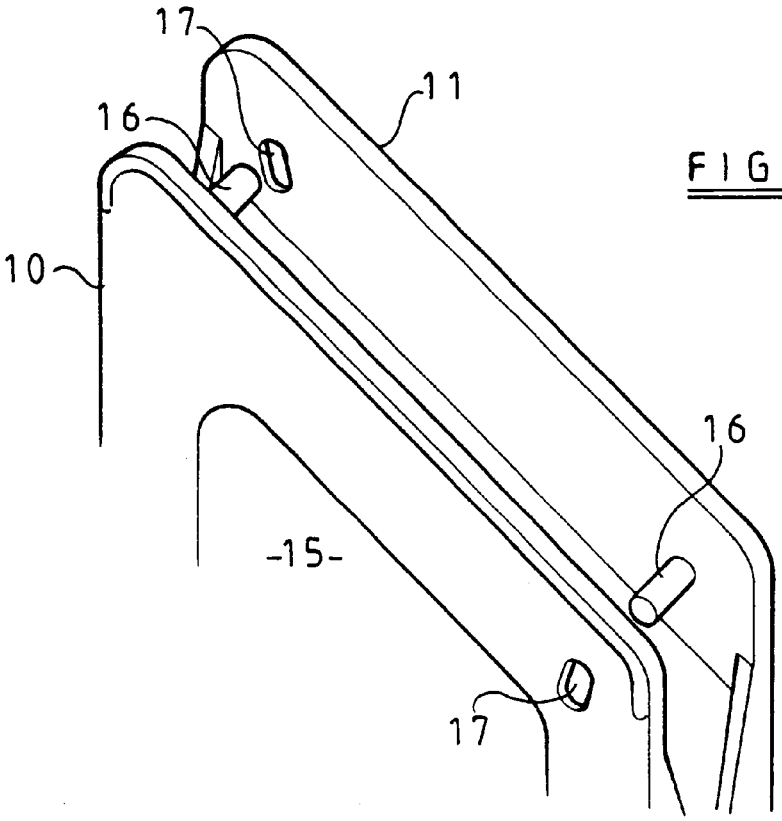
Figure 4:
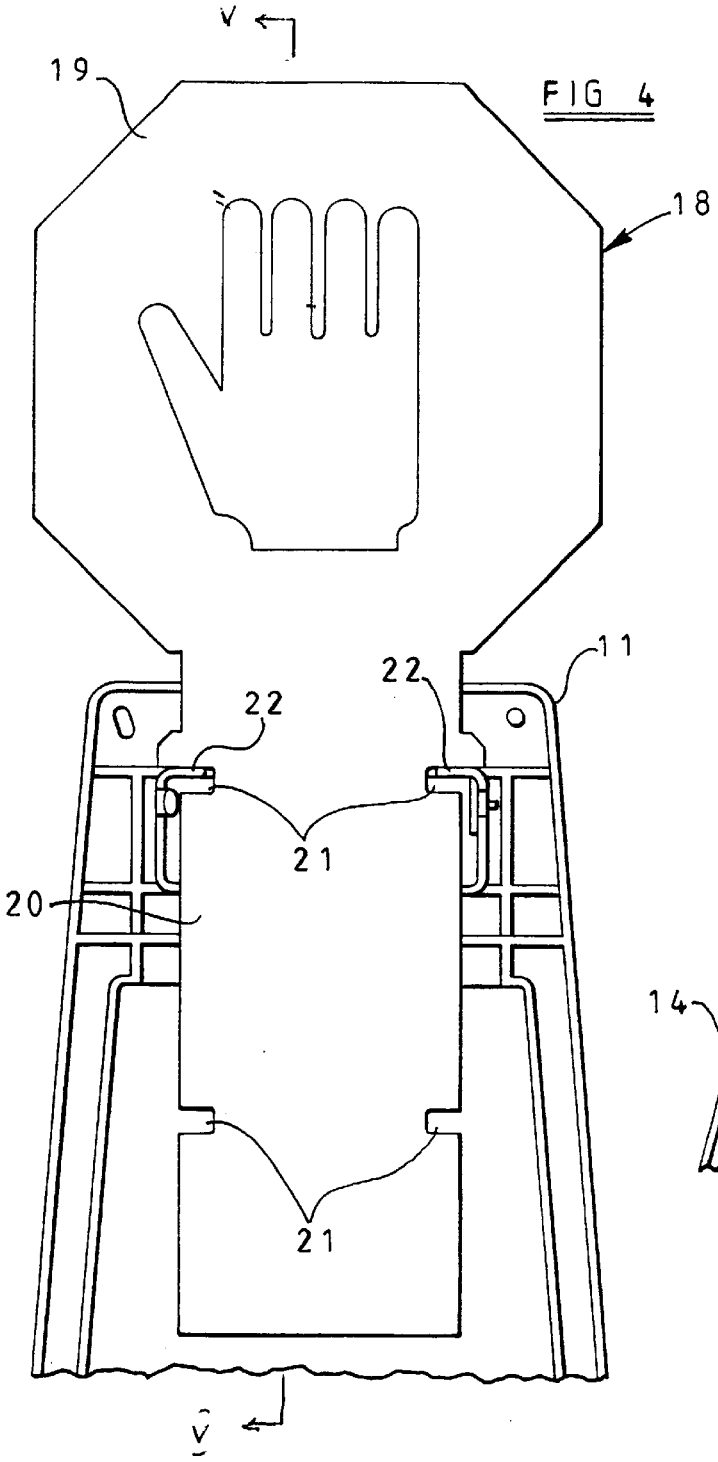
Figure 5:
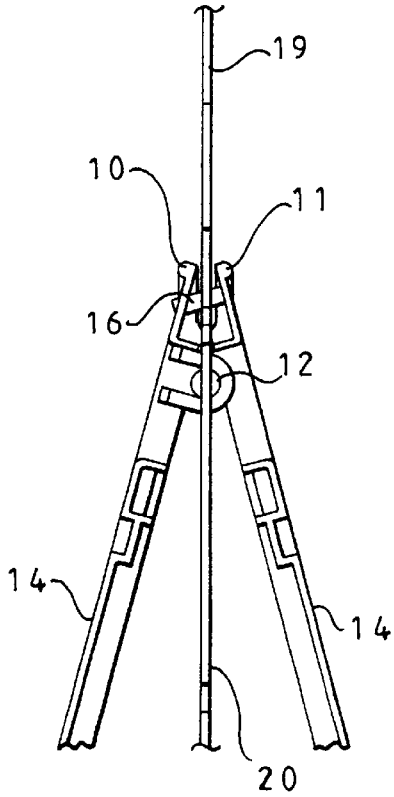

The invention will now be more particularly described by way of example, with reference to the accompanying drawings, in which:

FIG. 1 is a perspective view showing one embodiment of a warning sign according to the first aspect of the invention, in an operative position, FIG. 2 is a fragmentary perspective view showing a hinge between first and second parts of the warning sign shown in FIG. 1, FIG. 3 is a fragmentary perspective view showing the upper part of the first and second parts of the warning sign in a storage position, FIG. 4 is a vertical section taken between the first and second parts of the warning sign but including also a third part which can be raised or lowered relative to the first and second parts, and FIG. 5 is a section taken along line V—V of FIG. 4.

Referring to the drawings, there is shown therein a warning sign which, for example, can be used to caution the general public in a public place that a potential hazard exists in the vicinity of the sign, such as a wet floor or maintenance work in a restaurant, hospital, train station and such like. The warning sign comprises first and second parts 10 and 11 pivotably connected together by hinges 12 at the in use upper ends of the two parts 10 and 11 for movement between a first storage position in which the two parts lie parallel in a side-by-side relationship (see FIG. 3) and a second operative position in which the two parts are at an angle to one another (see FIG. 1). Each part 10, 11 has feet 13 at its in use lower end so that when the parts 10 and 11 are in the second operative position, the feet will support the sign in an upright position as shown in FIG. 1.

Each part 10 and 11 has a recess 14, for receiving a caution sign, and a hand hole 15.

As best seen in FIG. 3, each part 10, 11 has a projection 16 at the upper end of its inner face above the hinges 12 that securely releasably engages an aperture or recess 17 in the other part 11I 10 when the two parts 10 and 11 are in the second operative position. The projections 16 are a snap or friction fit in corresponding apertures or recesses 17 to allow the two parts to retain the second operative position, thereby reducing a tendency for the sign to collapse and/or fall over when impacted.

As shown in FIGS. 4 and 5, the sign also comprises a third "pop-up" part 18. This third part 18 comprises a head portion 19 having the caution sign on each of its two major faces and a stem portion 20 which, when the first and second parts 10 and 11 are in the first storage position, is slidable therebetween allowing the third part 18 to be adjusted between a lowered position in which the head portion 19 is just above the upper ends of the first and second parts 10 and 11, and a second raised position.

The stem portion 20 has two pairs of recesses 21. The recesses of each pair are horizontally aligned when the sign is in an upright position and the two pairs of recesses 21 are spaced vertically from one another. When the warning sign is in the second operative position, these recesses 21 receive projections 22 formed on each of the first and second parts 10 and 11. This allows the third part 18 to be securely supported in the raised (or lowered) position. The third part 18 can only be released from its raised (or lowered) position relative to the first and second parts 10 and 11 by moving the first and second parts from the second operative position, thus releasing the projections 22 from the recesses 21.

Typically, all parts are formed of plastics material with the third part 18 preferably being resiliently flexible in a direction parallel to the ground on which the warning sign is erected. Due to this flexibility and the secure support of the third part 18 at the recesses 21 when in the operative position, stability of the warning sign is increased due to the realisation of a "pendulum" effect that allows reversal of momentum on impact of the third part 18, i.e. when a person accidently knocks the caution sign with a shoulder bag, for example, thus resulting in little or no relative movement of the warning sign subsequent to impact.

What is claimed is:

1. A warning sign comprising:

(a) a set of swing legs hinge connected at upper ends, said legs being spreadable for self-support on a ground surface;

(b) an extension member moveable from a stowed position between said legs to a raised position extending above said legs upper ends so as to enhance visual warning effect of said sign; and (c) a catch associated with said hinge connections and operable to selectively lock said extension member into a raised, extended position from a lowered, stowed position.

2. The warning sign set forth in claim 1 wherein said extension member has upper slots and lower slots, the lower slots as part of said catch to hold said extension member in said raised position and the upper slots as part of said catch to hold said extension member in a stowed position.

3. The warning sign set forth in claim 2 wherein said catch includes said slots and a projection extendible into said slots.

4. A warning sign comprising:

(a) a set of swing legs hinge connected at upper ends, said legs being spreadable for self-support on a ground surface;

(b) an extension slidably positioned between said lets and moveable from a lowered, stowed position to a raised, extended position for enhancing visual warning effect of said sign; and (c) a catch arrangement between said legs and consisting of slots in said extension member and projections in said legs, the projections extending through said slots when said legs are spread apart so as to lock said extension member in position and retracting as said legs are swung together so as to permit said extension member to be lowered at least partway between said legs.

* * * * *